US008689514B1

(12) United States Patent
Sternowski

(10) Patent No.: US 8,689,514 B1
(45) Date of Patent: Apr. 8, 2014

(54) EXPANDABLE STRUCTURE

(75) Inventor: Robert Sternowski, Cedar Rapids, IA (US)

(73) Assignee: Softronics, Ltd., Marion, IA (US)

( * ) Notice: Subject to any disclaimer, the term of this patent is extended or adjusted under 35 U.S.C. 154(b) by 23 days.

(21) Appl. No.: 13/426,288

(22) Filed: Mar. 21, 2012

Related U.S. Application Data

(60) Provisional application No. 61/482,257, filed on May 4, 2011.

(51) Int. Cl.
*E04H 12/18* (2006.01)
*E04B 1/19* (2006.01)

(52) U.S. Cl.
CPC ..... *E04B 1/19* (2013.01)
USPC ..... 52/646; 52/635

(58) Field of Classification Search
CPC ..... E04C 3/09; E04C 3/005; E04C 3/07; E04C 5/04; E04C 2/427; E04C 2/42; E04B 1/19; E04B 1/1909; B21D 47/02; B21D 31/04
USPC ..... 52/633, 634, 635, 636, 646, 647
See application file for complete search history.

(56) References Cited

U.S. PATENT DOCUMENTS

| | | | | |
|---|---|---|---|---|
| 3,913,105 | A * | 10/1975 | Williamson et al. | 343/840 |
| 4,115,975 | A * | 9/1978 | Bliss | 52/646 |
| 4,295,637 | A * | 10/1981 | Hulek | 256/13.1 |
| 4,532,742 | A * | 8/1985 | Miura | 52/108 |
| 4,637,192 | A * | 1/1987 | Brown | 52/632 |
| 4,819,399 | A * | 4/1989 | Onoda | 52/646 |
| 5,024,031 | A * | 6/1991 | Hoberman | 52/81.2 |
| 5,163,262 | A * | 11/1992 | Adams | 52/646 |
| 5,688,604 | A * | 11/1997 | Matan et al. | 428/542.2 |
| 6,082,056 | A * | 7/2000 | Hoberman | 52/81.5 |
| 6,345,482 | B1 * | 2/2002 | Warren | 52/646 |
| 6,401,404 | B1 | 6/2002 | Fillipp et al. | |
| 6,447,928 | B2 * | 9/2002 | Suitts | 428/573 |
| 6,910,308 | B2 * | 6/2005 | Cadogan et al. | 52/646 |
| 7,694,486 | B2 * | 4/2010 | Murphy et al. | 52/645 |
| 7,712,261 | B2 * | 5/2010 | Zeigler | 52/79.5 |
| 7,832,170 | B2 * | 11/2010 | Zeigler | 52/646 |
| 7,987,864 | B1 * | 8/2011 | Jackson | 135/123 |
| 8,011,162 | B2 * | 9/2011 | Overby | 52/745.17 |
| 8,084,117 | B2 * | 12/2011 | Lalvani | 428/136 |
| 8,320,727 | B1 * | 11/2012 | Jacobsen et al. | 385/129 |

(Continued)

OTHER PUBLICATIONS

Able Engineering Company, Inc. Coilable Booms product literature, Goleta, California.

(Continued)

*Primary Examiner* — William Gilbert
*Assistant Examiner* — Gisele Ford
(74) *Attorney, Agent, or Firm* — Jason R. Sytsma; Shuttleworth & Ingersoll, PLC

(57) ABSTRACT

An expandable structure formed from a single piece of material is moveable between a stowed position and an extended position. The structure has a base and a plurality of support members integral with the base that move between a stowed position and an extended position. In the stowed position, the base and the plurality of support members are essentially a two dimensional shape. A biasing force makes the structure self-erecting and moves it to the extended position. In the extended position, the expandable structure has a hollow interior and a cross-section that is bounded by a closed path.

53 Claims, 7 Drawing Sheets

(56) References Cited

U.S. PATENT DOCUMENTS

| | | | | |
|---|---|---|---|---|
| 8,356,448 | B2 * | 1/2013 | Nihei | 52/223.8 |
| 8,371,088 | B2 * | 2/2013 | Merrifield | 52/646 |
| 8,402,711 | B2 * | 3/2013 | Lusk et al. | 52/646 |
| 8,424,265 | B2 * | 4/2013 | Lusk | 52/646 |
| 8,484,925 | B2 * | 7/2013 | Daas et al. | 52/646 |
| 2009/0171426 | A1 | 7/2009 | Magnuson | |
| 2010/0319270 | A1 * | 12/2010 | Slade | 52/71 |

OTHER PUBLICATIONS

Surrey Satellite Technology, LTD., SSTL-Weitzmann 6m Deployable Boom data sheet, 2001, Guildford, Surrey, UK.

David W. Gulick and Earl A. Thornton, Thermally-Induced Vibrations of a Spinning Spacecraft Boom article, 1995, Acta Astronautica vol. 36, No. 3, pp. 166-176, Elsevier Science, Ltd., Great Britian.

* cited by examiner

EXPANDABLE STRUCTURE

CROSS REFERENCE TO RELATED APPLICATIONS

This application claims priority under 35 USC §119 from copending provisional patent application entitled EXTENDABLE BOOM, Ser. No. 61/482,257, filed May 4, 2011, which application is hereby incorporated in its entirety.

BACKGROUND OF THE INVENTION

Satellites typically have large structures for antennas and masts for booms that position instrument sensors large distances from the satellite body. Such structures may range up to 200 feet in length, and use well-known methods for erecting triangular or square tower sections. Such structures are typically used in very large satellites, ranging to tons of on-orbit weight. When smaller masts or poles are required, a telescoping tube mast can be used; however, the telescoping mast must trade off length for number of sections (and attendant weight and diameter).

Development of a reduced volume satellite known as a nano-sat or "CubeSat" whose outer dimension is a 10 cm cube and weighs no more than 1 kg, enables space research with less expense. The need in nano-sats is for instrument booms in the range of 10-20 feet, and antenna elements within the range of 20-100 feet. For antennas, often two such elements are used in a center-fed dipole configuration. However, given a limit of 1 kg of mass in a 10 cm cube, none of the available technologies for masts or booms can provide a structure which would fit within those constraints, much less leave any mass or volume for the remaining satellite instruments and equipment.

SUMMARY

According to the present invention, there is provided an expandable structure moveable between a stowed position and an extended position. The structure has a base, and a plurality of support members formed as a single unit with the base that move between a stowed position and an extended position. In the stowed position, the base and the plurality of support members are essentially a two-dimensional shape. A biasing force makes the structure self-erecting and moves it to the extended position. In the extended position, the expandable structure has a hollow interior and a cross-section that is bounded by a closed path.

A method for manufacturing a unitary or monolithic self-erecting boom is also disclosed. A plurality of slits are opened in a sheet of material by chemical etching or laser cutting. Any material capable of acquiring or inherently possessing a spatial memory will allow the structure to be self-erecting. After the slits are formed, the structure is expanded perpendicularly away from a plane defined by the sheet of material. The expanded structure is treated in a manner to cause the material to rest in the erected position. One such manner of treatment for the material includes heating the material, then quenching it, while the structure is in the erected position, to cause the material to rest in the erected position.

These and other aspects, features, and advantages of the invention will become apparent upon review of the following description taken in connection with the accompanying drawings. The invention, though, is pointed out with particularity by the appended claims.

BRIEF DESCRIPTION OF THE DRAWINGS

Specific features of the present invention are more fully disclosed in the following specification, reference being had to the accompanying drawings.

DETAILED DESCRIPTION OF THE INVENTION

Figure 3:
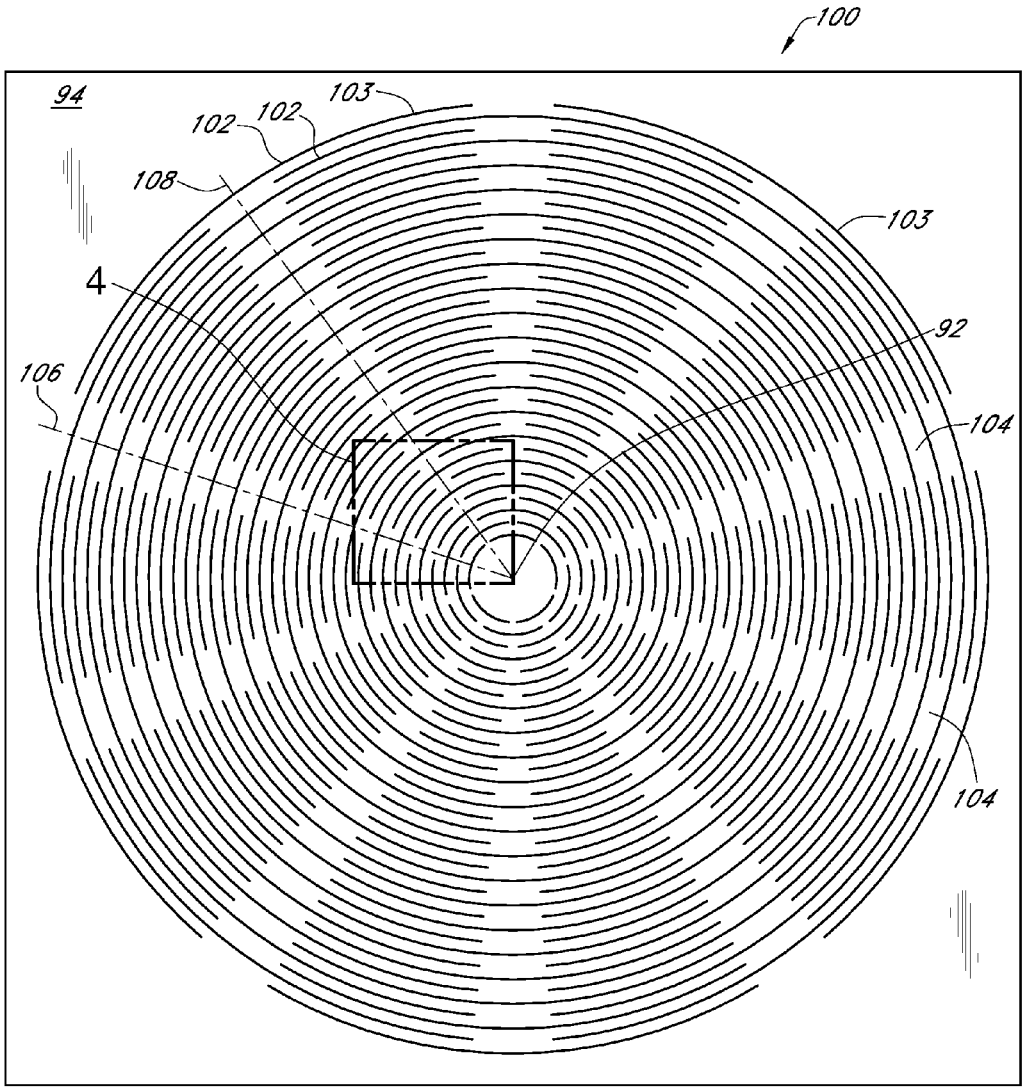
FIG. 3 is the expandable structure of FIG. 1 in the collapsed position.

The present disclosure is directed toward a unitary or monolithic expandable structure formed from a single piece of material and a method for making the same. FIG. 3 illustrates an expandable structure 100 in the collapsed position. It can be seen that expandable structure 100 comprises a plurality of concentric broken rings 102 formed around an axis 92. Each concentric ring 102 is formed by a plurality of slits 103 of equal length spaced apart equidistantly about ring 102. Each slit 103 is separated by a connecting tab or joint 104 of equal length spaced equidistantly apart. Joints 104 in each concentric ring 102 are spaced 36 degrees apart from each other about each concentric broken ring 102 to interconnect adjacent concentric rings 102.

Figure 1:
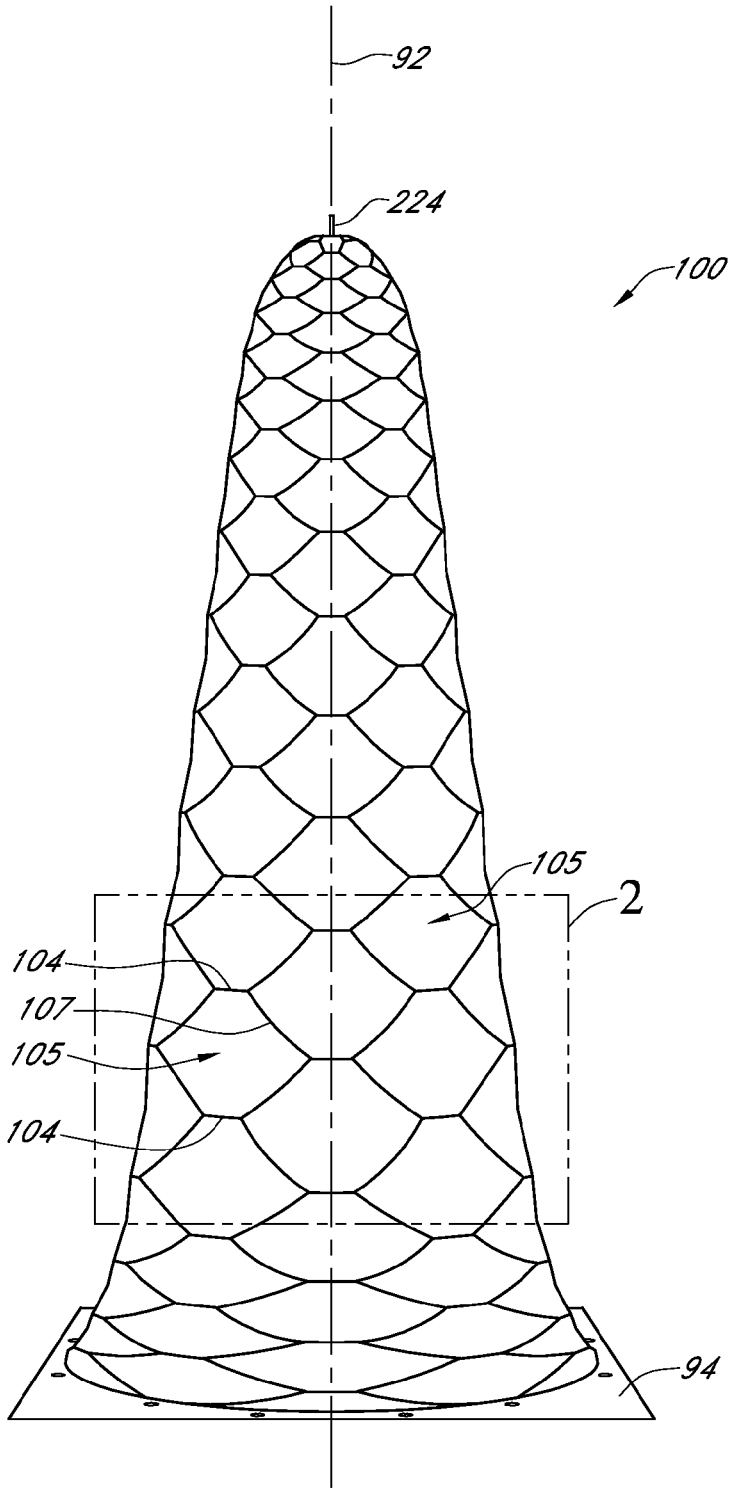
FIG. 1 is an expandable structure in the extended position.
Figure 2:
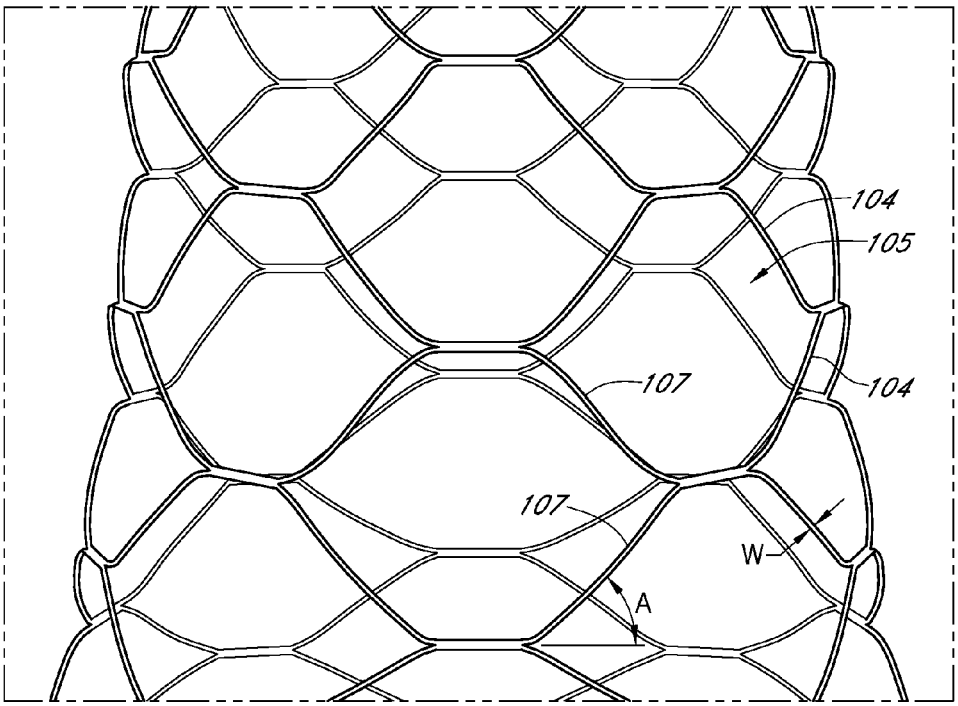
FIG. 2 is an enlargement of a segment of the expandable structure of FIG. 1.
Figure 4:
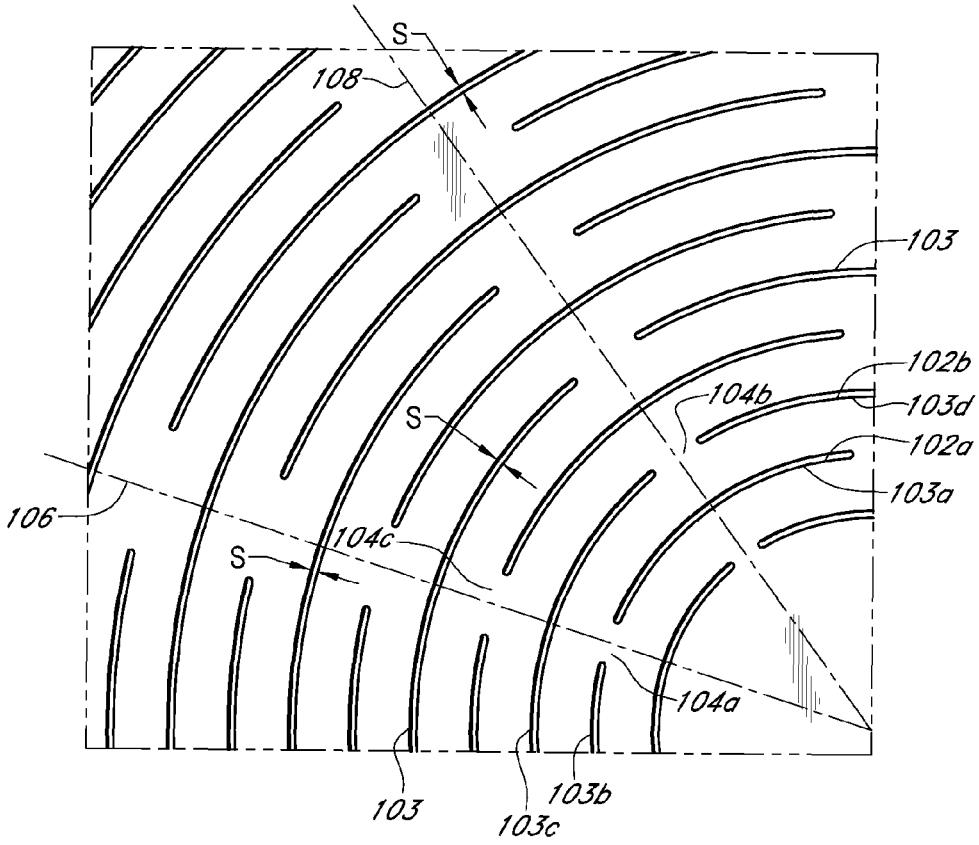
FIG. 4 is an enlargement of area 4 of FIG. 3.

FIG. 4 shows an enlargement of concentric rings 102 and the alternating pattern of slits 103 and joints 104, which creates the alternating pattern of joints 104 and slits 103 shown in FIG. 1. Expandable structure 100 is formed by chemically etching a pattern in a base 94 to create expandable structure 100, shown in FIG. 1. Base 94 is a monolithic solid sheet shape that permits elongation of the shape through expansion of slits 103 and whose initial dimension represents the collapsed stowage dimension of extendible structure 100. Concentric rings 102 are formed in base 94. Each slit 103 in concentric ring 102 has a width "S" and is spaced apart from adjoining circumferential slits 103 by a connecting joint 104.

Returning to FIG. 3, a first ray 106 and a second ray 108 projecting from axis 92 aids in describing the angular spacing of adjacent concentric ring's 102 joints 104. Ray 106 and ray 108 are angularly separated by 36 degrees. The spacing of the ray 108 with respect to ray 106 is determined by one-half the circumferential distance of slits 103. Around the circumference of each concentric rings 102, joints 104 are positioned 72 degrees apart from each other. Each joint 104 in the adjacent concentric rings 102 are positioned 36 degrees apart from each other, i.e. one-half the angular distance between joints 104 in adjacent concentric rings 102. This arrangement of joints 104 with respect to slits 103 interconnects adjacent concentric rings 102 to form a monolithic structure. For example, FIG. 4 shows adjacent concentric rings 102*a* and 102*b*. Concentric ring 102*a* has joint 104*a* between slit 103*a* and 103*b*. Concentric ring 102*b* has joint 104*b* between slit 103*c* and 103*d*. Joint 104*a* is positioned 36 degrees from joint 104*b*. As such, joints 104*a* and 104*b* form connecting side walls for cell 105 and support members for expandable structure 100.

The extended length of expandable structure 100 is a function of: a) the allowable collapsed dimensions of base 94; b) the width of the slits 103 in each concentric ring 102; and c) the number of joints 104 in each concentric ring 102. It can be shown mathematically that the extension length is approximately given by:

$$L=M*[\sin A*(0.5*Cavg/N]$$

Where

L=the extended length

M=number of concentric rings 102

A=angle of structural cell

Cavg=average circumference of concentric rings 102

N=number of joints per ring 104

The structural strength of expandable structure 100 is a function of material choice for base 94 and the thickness and width of concentric rings 102. The thickness of concentric rings 102 affects the overall collapsed dimensional size of expandable structure 100 and the width of concentric rings its overall extended length "L."

The width of slits 103 should be minimized as it consumes material that would otherwise be used for extended length "L" of expandable structure 100. In the preferred embodiment, slits 103 are 0.002 inches wide, which leaves enough room between adjacent support members 107 for expandable structure 100 to collapse and expand. The width of slits 103 may generally be limited by available fabrication processes for the selected material and the thickness of the fabrication material. The preferred fabrication method is chemical etching, because it allows the thinnest slits 103 to be manufactured without annealing the material during the fabrication process. Machining or laser cutting slits 103 are also viable fabrication alternatives.

FIG. 1 shows expandable structure 100 in the extended position. In the extended position, expandable structure 100 is a three-dimensional structure having a cross-section bounded by a closed path, as opposed to a two-dimensional structure that has a cross-section forming a straight line. The number of joints 104 determines the bending moment, or the amount of "sway" in expandable structure 100. A minimum of three joints 104 is required to have a stable structural cell 105; however, providing more joints 104 reduces the bending moment or sway. Conversely, adding more joints 104 reduces the extension length per concentric ring 102, thereby requiring more concentric rings 102 for a given length, and affecting the structural strength (a function of ring width) and the collapsed size. It has been observed that an odd number of joints 104 improves the bending moment, in contrast to an even number of joints 104.

In the extended position, expandable structure 100 is a lattice structure and defined by a plurality of structural cells 105 surrounding a void. Expandable structure 100 is expanded upward on a central axis 92 perpendicularly away from a plane defined by base 94. The expandable structure can also expand upward in a curved path where the central axis is replaced with an imaginary line with a locust locus of points equidistant apart. As expandable structure 100 expands upward, structural cells 105 begin to form from joints 104 moving away from base 94 leaving a void, and thereby creating a circular or oval cross-section having a defined circumferential path.

The angle "A" of structural cell 105 is a function of how far the machined material is extended from its collapsed size. More specifically, angle "A" of structural cell 105 is the angle formed by a side wall 107 of structural cell 105 with respect a line parallel to base 94, wherein side walls 107 form support members for expandable structure 100 in the extended position, and the support members are interconnected at angles with respect to each other. While the angle A may be set as desired by mechanical extension of the boom in accordance with the designed stress analysis, it has been observed that a 45-degree angle in all structural cells 105 seems to provide the optimum compromise between extension length and bending moment. Angles of 45 degrees or less will also preserve the integrity of expandable structure 100 in instances where it is repeatedly extended and retracted.

Because expandable structure 100 is a monolithic structure, i.e. formed from a single piece of material, it is preferably formed from a material capable of acquiring or inherently possessing a spatial memory so that it expands on its own without the requirement of additional biasing elements. An example of a useable material includes a material of a type that can be extended to the design length and shape, and then treated by a suitable process to cause the structure to "set" in the extended shape. Such a material can include high-carbon steel (such as annealed type 1074/1075). After a planar blank of high-carbon steel is etched or machined, the structure is physically expanded and then spring tempered by heating the expanded structure, followed by quick quenching in a cool liquid such as oil. The crystalline molecular structure of the base material, usually metal, is thereby modified such that the structure 100 rests in its extended shape. Other combinations of materials and heat-treating processes can also be employed to "set" the expanded shape. Furthermore, materials inherently possessing a spatial memory, such as plastic or carbon fiber windings, can be used to form expandable structure 100. In such embodiments, the three-dimensional shapes inherently possessing spatial memory are formed. The three-dimensional shapes are then compressed to the collapsed position for use.

Figure 5:
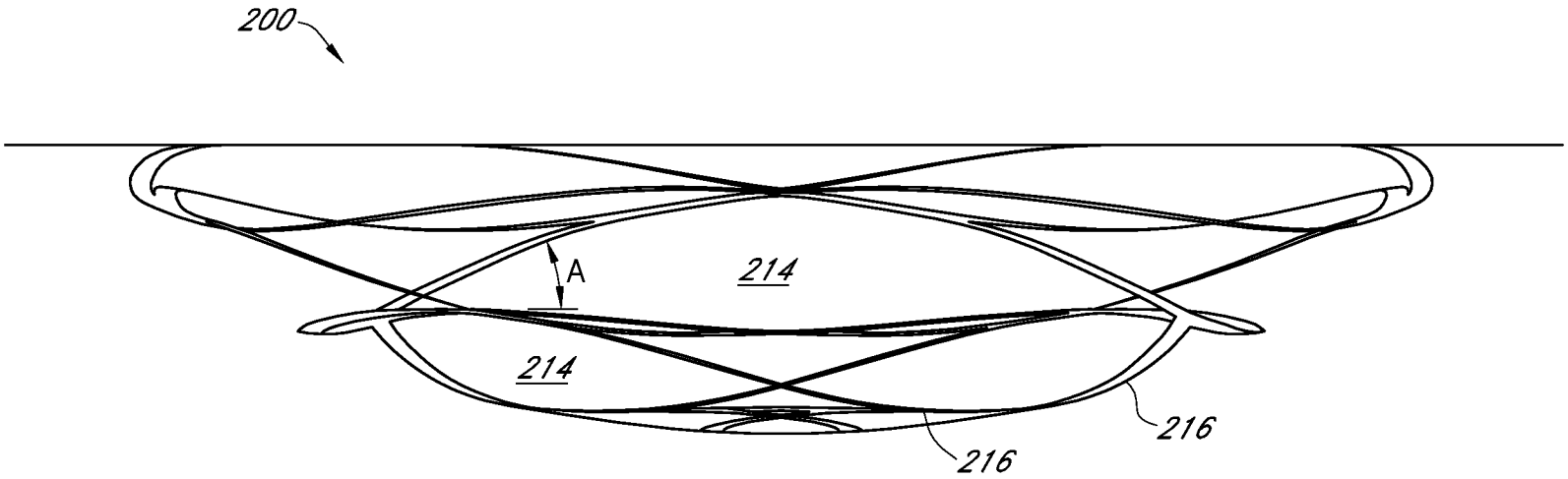
FIG. 5 is an alternative embodiment of a generally hemispherical-shaped expandable structure in the extended position.
Figure 6:
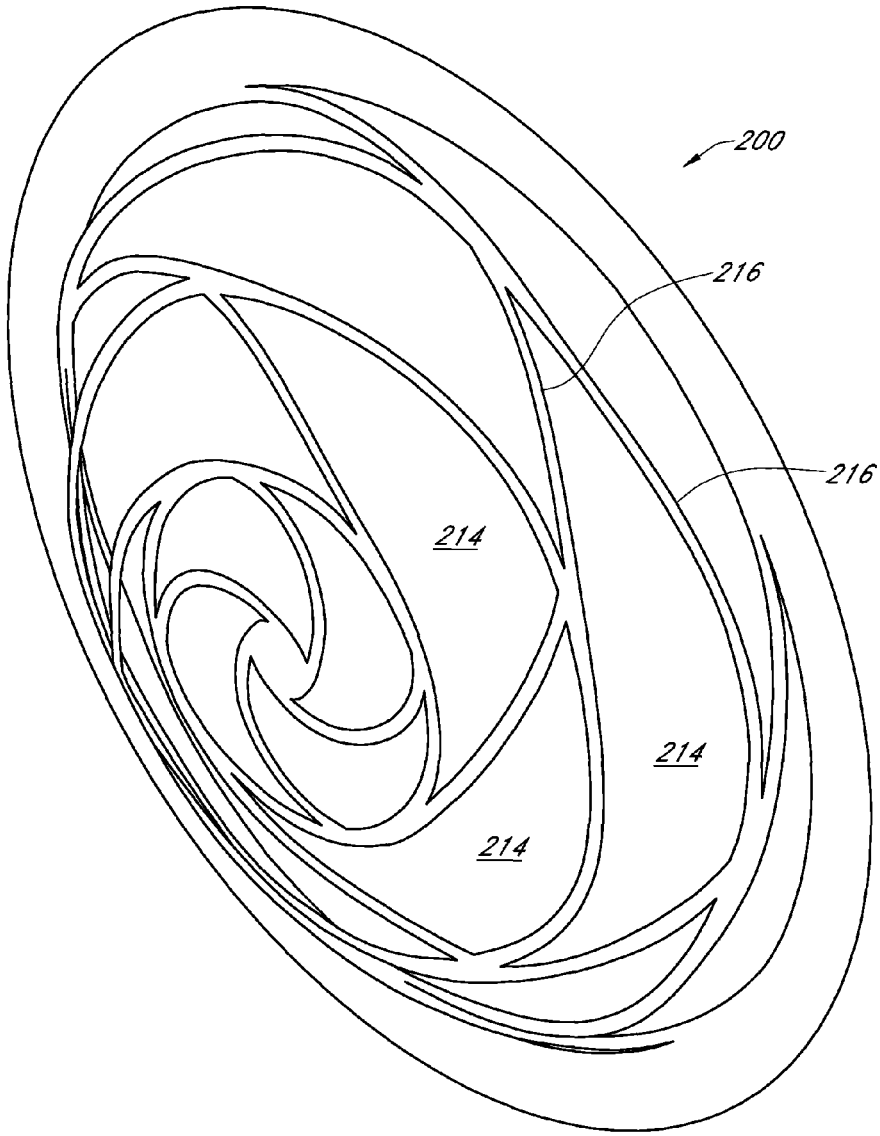
FIG. 6 is a perspective view of the generally hemispherical-shaped expandable structure of FIG. 5.
Figure 7:
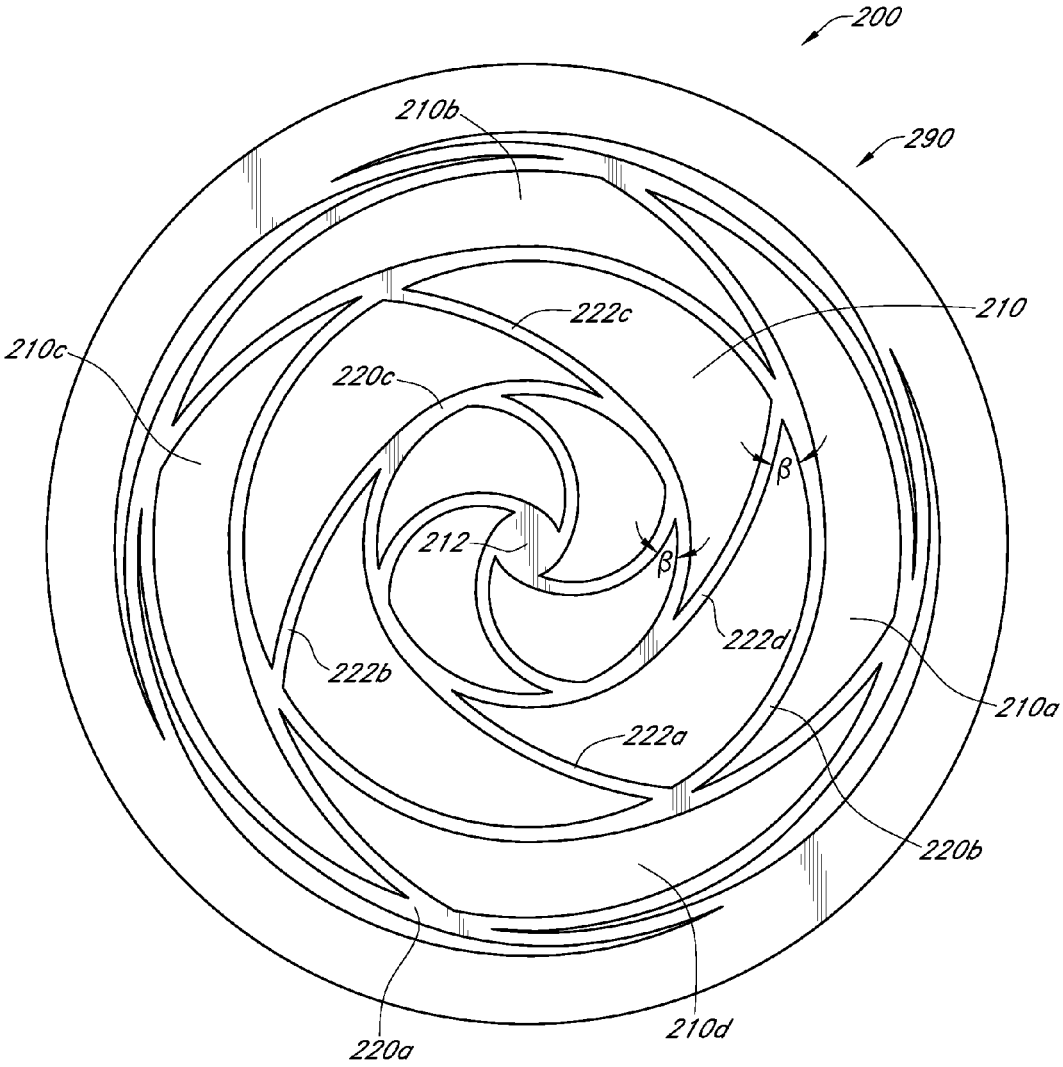
FIG. 7 is the expandable structure of FIG. 5 in the collapsed position.

Various three-dimensional shapes defined as a monolithic structure are contemplated, including extended structures having round, cylindrical, spherical, or polygonal cross-sections and a hollow interior or void. FIGS. 5 and 6 show a hemispherically-shaped expandable structure 200. FIG. 7 illustrates hemispherically-shaped expandable structure 200 in the collapsed position. A plurality of arcuate cuts 210 are formed around an axis 212 in the center. Each arcuate cut 210 is rotated with respect to its adjacent arcuate cut 210, preferably 45 degrees, creating four arcuate cuts **210*a*-210*d* around a circumference. The material remaining provides form and structural support for hemispherically-shaped expandable structure 200, and includes a plurality of concentric rings 220*a*-*c*. Each adjacent concentric ring 220*a*-*c* is interconnected with each other by a plurality of joints 222, wherein joints 222 form the support members for the hemisphericaily-shaped expandable structure 200 in the extended position. Joints 222 are angularly attached to one of the concentric rings 220** an angle "β" (discussed below)

In the extended position, hemispherical-shaped expandable structure 200 is defined by a plurality of arcuate structural cells 214 surrounding a hollow inside and with a circular cross-section defining a closed path. The angle "β" of structural cell 214 is a function of how far the machined material is extended from its collapsed size, similar to angle "A" of structural cell 105 in expandable structure 100. A plurality of joints 222 similarly determines the bending moment, or the amount of "sway" in arcuate structural cells 214. A minimum of three joints 222 are required to have stable arcuate structural cells 214.

An expandable structure is particularly useful as an instrument boom and antenna mast for a "Cubesat" miniature satellite. As previously discussed, the Cubesat is a standardized satellite whose outer dimension is a 10 cm cube, which may have a weight of no more than 1 kg. Expandable structure 100 occupies a very low volume in its stowed configuration in order to preserve volume for the remaining satellite equipment. Expandable structure 100 is constructed from a single piece of material, so that base 94 and joints 104 that form the support members for the expandable structure are a single, unitary piece of material. Base 94 is preferably a thin sheet of material no more than 10 cm square so that it can be mounted on an outside surface of the Cubesat. Expandable structure 100 is self-erecting from its stowed form by removing a hinged, locked cover or other mechanical retainer. When the mechanical retainer is released (for instance, instance by a fuse wire or solenoid on the Cubesat), the spring force of the collapsed expandable structure 100 will push the hinged cover out of the way, and the expandable structure 100 will expand out to its extended form. Instruments or other apparatus may be mounted on the expandable structure and will be deployed by the spring force of the expandable structure as it self-erects.

In an alternative embodiment, expandable structure 100 may be proportionally scaled up in size for use as a flat, roof-mounted radio mast for a vehicle, such as a military vehicle. An antenna or other device is mounted to a tip 224 of the expandable structure 100. A winch and line from the bottom side of expandable structure 100 connects to tip 224. To raise the mast with the antenna, a winch reels out a line to allow expandable structure 100 to extend. To collapse the mast, the winch reels in the line in a vertical path until the structure is once again flat against the roof.

In yet another embodiment, expandable structure 100 is not spring tempered. Expandable structure 100 is sprung by mechanically extending, by application of external force, and permanently leaving expandable structure 100 in the extended state.

In another embodiment, concentric structures (for example, two or more flat two-dimensional structures positioned in alignment over each other so that concentric extended structures result) are employed to add structural strength. For example, two hemispherically-shaped expandable structures 200 are positioned with respect to each other, such that in the extended position, a spherical structure is formed.

In another embodiment, expandable structure 100 may be partially or fully coated with a dampening substance to add vibration immunity or coated with an anti-corrosive substance to extend its useful life.

In yet another embodiment, variations in ring thickness and shapes may be used, rather than an even and constant dimension over the extended length of the structure. For example, ring thickness may be tapered, being thickest at the base and thinnest at the top where stress and weight are lowest. In another example, a length of the extended structure may be constructed of rings of width $W_1$, and a second length of the structure may be constructed of rings of width $W_2$, for reasons unique to an application. Many geometric variations are anticipated.

In an alternative embodiment, an expandable structure is constructed from a three-dimensional base that includes a pattern of slits and joints in spaced apart rings. A desired or required collapsed shape, such as a round tube, square tube, rectangular tube, oval tube, frustoconical segment or any other hollow closed or open shape may determine the choice of a starting structural member shape. The design and usage are similar to the two-dimensional flat structure, but simply adapted mechanically to the peculiar shape at hand.

Expandable structure 100 has several advantages over prior art designs. Expandable structure 100 is monolithic, not requiring complex and cumbersome mechanisms. Such mechanisms are labor-intensive to construct and heavier than a single, unitary structure. Furthermore, a monolithic structure is more reliable than complex mechanisms that have many points susceptible to failure.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents.

What is claimed is:

1. A unitary expandable structure moveable between a stowed position and an extended position, the structure comprising:

a base; and a plurality of interconnected support members separated by slits in the base and connected with respect to each other at an angle and unitary with the base, wherein the support members move between a stowed position and an extended position, wherein in the extended position the expandable structure has a cross-section that is bounded by a closed path, and wherein each of the slits opens in an arcuate shape having a radius which extends generally from a center point of the expandable structure.

2. The expandable structure of claim 1, wherein a biasing force moves the support members to the extended position.

3. The expandable structure of claim 1, wherein the expandable structure self-expands to the extended position.

4. The expandable structure of claim 1, wherein in the stowed position the base and the plurality of support members are essentially a two dimensional shape.

5. The expandable structure of claim 4, wherein the expandable structure self-expands to the extended position.

6. The expandable structure of claim 1, wherein the expandable structure is heat treated while in the extended position to give the expandable structure a spatial memory which urges the expandable structure from the stowed position to the extended position.

7. The expandable structure of claim 6, wherein the expandable structure is annealed then quenched while in the extended position to give the expandable structure a spatial memory which urges the expandable structure from the stowed position to the extended position.

8. The expandable structure of claim 1, wherein the plurality of support members are arcuate shaped being formed by arcuate slits cut into the base.

9. The expandable structure of claim 8, wherein a biasing force moves the support members to the extended position.

10. The expandable structure of claim 9, wherein the expandable structure self-expands to the extended position.

11. The expandable structure of claim 10, wherein in the stowed position the support members are generally parallel with the base and the base and the support members share a generally consistent thickness, and wherein in the extended position the support members are positioned at an angle with respect to the base and surround the expandable structure such creating a hollow inside.

12. A monolithic expandable structure moveable between a stowed position and an extended position, the structure comprising:

a base; and a plurality of support members separated by slits in the base and unitary with each other and unitary with the base, wherein the support members move between a stowed position and an extended position, wherein the plurality of support members define a lattice structure when the expandable structure is in the extended position, and wherein in the extended position the expandable structure has a cross-section that is bounded by a closed path, and wherein each lattice of the lattice structure is defined by the plurality of support members and each of the slits opens in an arcuate shape having a radius which extends generally from a center point of the expandable structure.

13. The expandable structure of claim 12, wherein the expandable structure is monolithic, formed from a single piece of material.

14. The expandable structure of claim 12, wherein a biasing force moves the support members to the extended position.

15. The expandable structure of claim 12, wherein the expandable structure self-expands to the extended position.

16. The expandable structure of claim 12, wherein in the stowed position the base and the plurality of support members are essentially a two dimensional shape.

17. The expandable structure of claim 16, wherein the expandable structure self-expands to the extended position.

18. The expandable structure of claim 12, wherein the expandable structure is heat treated while in the extended position to give the expandable structure a spatial memory which urges the expandable structure from the stowed position to the extended position.

19. The expandable structure of claim 18, wherein the expandable structure is annealed then quenched while in the extended position to give the expandable structure a spatial memory which urges the expandable structure from the stowed position to the extended position.

20. The expandable structure of claim 12, wherein the plurality of support members are arcuate shaped being formed by arcuate slits cut into the base.

21. The expandable structure of claim 20, wherein a biasing force moves the support members to the extended position.

22. The expandable structure of claim 21, wherein the expandable structure self-expands to the extended position.

23. The expandable structure of claim 22, wherein in the stowed position the support members are generally parallel with the base and the base and the support members share a generally consistent thickness, and wherein in the extended position the support members are positioned at an angle with respect to the base and surround the expandable structure such creating a hollow inside.

24. The expandable structure of claim 12, wherein the plurality of support members are interconnected with respect to each other at an angle.

25. A unitary expandable structure moveable between a stowed position and an extended position, the structure comprising:

a base; and a plurality of support members unitary with the base and separated by slits in the base, wherein the support members move between a stowed position and an extended position, wherein in the extended position the expandable structure has a cross-section that is bounded by a closed path, and each of the slits opens in an arcuate shape having a radius which extends generally from a center point of the expandable structure.

26. The expandable structure of claim 25, wherein the plurality of support members define a lattice structure when the expandable structure is in the extended position.

27. The expandable structure of claim 26, wherein in the extended position the expandable structure has a cross-section that is bounded by a closed path.

28. The expandable structure of claim 26, wherein a biasing force moves the support members to the extended position.

29. The expandable structure of claim 26, wherein the expandable structure self-expands to the extended position.

30. The expandable structure of claim 29, wherein in the stowed position the base and the plurality of support members are essentially a two dimensional shape.

31. The expandable structure of claim 30, wherein the expandable structure self-expands to the extended position.

32. The expandable structure of claim 25, wherein the expandable structure is heat treated while in the extended position to give the expandable structure a spatial memory which urges the expandable structure from the stowed position to the extended position.

33. The expandable structure of claim 32, wherein the expandable structure is annealed then quenched while in the extended position to give the expandable structure a spatial memory which urges the expandable structure from the stowed position to the extended position.

34. The expandable structure of claim 25, wherein the plurality of support members are arcuate shaped being formed by arcuate slits cut into the base.

35. The expandable structure of claim 34, wherein a biasing force moves the support members to the extended position.

36. The expandable structure of claim 35, wherein the expandable structure self-expands to the extended position.

37. The expandable structure of claim 36, wherein in the stowed position the support members are generally parallel with the base and the base and the support members share a generally consistent thickness, and wherein in the extended position the support members are positioned at an angle with respect to the base and surround the expandable structure such creating a hollow inside.

38. The expandable structure of claim 36, wherein the plurality of support members are interconnected with respect to each other at an angle.

39. The expandable structure of claim 36, wherein the expandable structure is monolithic, formed from a single piece of material.

40. The expandable structure of claim 36, where the imaginary line with the locus of points equidistant apart is a central axis.

41. A unitary expandable structure moveable between a stowed position and an extended position, the structure comprising:

a base; and a plurality of interconnected support members separated by slits in the base and connected with respect to each other at an angle and unitary with the base, wherein the support members move between a stowed position and an extended position, wherein in the extended position the expandable structure has a cross-section that is bounded by a closed path, wherein each of the slits opens in an arcuate shape having a radius which extends generally from a center point of the expandable structure, and wherein a biasing force moves the support members to the extended position.

42. The expandable structure of claim 41, wherein the expandable structure self-expands to the extended position.

43. The expandable structure of claim 42, wherein in the stowed position the base and the plurality of support members are essentially a two dimensional shape.

44. The expandable structure of claim 42, wherein the expandable structure is heat treated while in the extended position to give the expandable structure a spatial memory which urges the expandable structure from the stowed position to the extended position.

45. The expandable structure of claim 44, wherein the expandable structure is annealed then quenched while in the extended position to give the expandable structure a spatial memory which urges the expandable structure from the stowed position to the extended position.

46. A monolithic expandable structure moveable between a stowed position and an extended position, the structure comprising:

a base; and a plurality of support members unitary with each other and unitary with the base and separated by slits, in the base wherein the support members move between a stowed position and an extended position, wherein the plurality of support members define a lattice structure including support members and joints when the expandable structure is in the extended position with each slit forming a space in the lattice, and wherein in the extended position the expandable structure has a cross-section that is bounded by a closed path, and wherein in the stowed position the slits are formed in the base and each of the slits opens in an arcuate shape having a radius which extends generally from a center point of the expandable structure.

47. The expandable structure of claim 46, wherein the expandable structure is heat treated while in the extended position to give the expandable structure a spatial memory which urges the expandable structure from the stowed position to the extended position.

48. The expandable structure of claim 47, wherein the expandable structure is annealed then quenched while in the extended position to give the expandable structure a spatial memory which urges the expandable structure from the stowed position to the extended position.

49. The expandable structure of claim 48, wherein the plurality of support members are interconnected with respect to each other at an angle.

50. A unitary expandable structure moveable between a stowed position and an extended position, the structure comprising:

a base; and a plurality of support members unitary with the base and separated by slits, in the base wherein the support members move between a stowed position and an extended position, wherein in the extended position the expandable structure has a cross-section that is bounded by a closed path, and wherein the expandable structure expands upward from a plane defined by the base on an imaginary line with a locus of points equidistant apart, wherein the plurality of support members define a lattice structure when the expandable structure is in the extended position, wherein the slits form spaces of the lattice structure when the structure is in the extended position and each of the slits opens in an arcuate shape having a radius which extends generally from a center point of the expandable structure.

51. The expandable structure of claim 50, wherein the expandable structure self-expands to the extended position.

52. The expandable structure of claim 51, wherein the expandable structure is heat treated while in the extended position to give the expandable structure a spatial memory which urges the expandable structure from the stowed position to the extended position.

53. The expandable structure of claim 51, wherein the expandable structure is annealed then quenched while in the extended position to give the expandable structure a spatial memory which urges the expandable structure from the stowed position to the extended position.

* * * * *